United States Patent [19]

Whitman et al.

[11] Patent Number: 4,995,222

[45] Date of Patent: Feb. 26, 1991

[54] AMPOULE SEALING APPARATUS

[75] Inventors: Charles R. Whitman, Ross Township, Kalamazoo County; John J. Dougherty, Jr., Paw Paw, both of Mich.

[73] Assignee: The Upjohn Company, Kalamazoo, Mich.

[21] Appl. No.: 462,128

[22] Filed: Jan. 8, 1990

[51] Int. Cl.[5] ..... B65B 31/02; B65B 1/22; B65B 51/10

[52] U.S. Cl. ..... 53/510; 53/525; 53/373

[58] Field of Search ..... 53/433, 434, 437, 486, 53/477, 510, 511, 512, 525, 373, 266 R, 276; 156/68

[56] References Cited

U.S. PATENT DOCUMENTS

| | | | |
|---|---|---|---|
| 1,864,023 | 6/1932 | Ledig . | |
| 2,198,752 | 4/1940 | Barr . | |
| 2,353,985 | 7/1944 | Barr . | |
| 2,749,688 | 6/1956 | Cozzoli . | |
| 2,896,381 | 7/1959 | Lange . | |
| 2,923,113 | 2/1960 | Tyson . | |
| 3,006,120 | 10/1961 | Gräfingholt | 53/512 X |
| 3,012,386 | 12/1961 | Pechmann et al. . | |
| 3,188,778 | 6/1965 | Wiener et al. . | |
| 3,488,915 | 1/1970 | Delestatius | 53/525 X |
| 3,496,695 | 2/1970 | Sickel | 53/510 X |
| 3,688,812 | 9/1972 | Fredericks . | |
| 4,596,109 | 6/1986 | Miller . | |

*Primary Examiner*—Horace M. Culver

*Attorney, Agent, or Firm*—Flynn, Thiel, Boutell & Tanis

[57] ABSTRACT

An ampoule sealing apparatus has a pivotable arm for moving an unsealed ampoule from a first position to a second position, a horseshoe-shaped burner defining an interior area in which the ampoule neck is received at the second position. A vibrator attached to the mechanical arm in order to help induce the evacuation of air from the ampoule. A vacuum source, optionally associated with a purge gas source, is associated with the mechanical arm in order to evacuate air from the ampoule and a thermocouple controller monitors the lighting of the burner and shuts off the flow of fuel thereto if the burner is not lit or if the flame is extinguished within a predetermined period of time.

7 Claims, 3 Drawing Sheets

AMPOULE SEALING APPARATUS

BACKGROUND OF THE INVENTION

1. Field of the Invention

This invention relates an ampoule sealing apparatus, particularly an apparatus for evacuating air from ampoules containing samples of proteins or peptides and then sealing the ampoules.

In the pharmaceutical and biotechnology industries, there often arises the need to analyze the amino acid composition of various proteins and peptides. This amino acid analysis is typically a multi-step procedure, the end result of which is the analytical determination of the concentration and the amino acid composition of the protein (or peptide) sample. The first step in this analytical process involves the hydrolysis of the protein (or peptide) to its constituent amino acids by use of a concentrated acid for effecting the hydrolysis. The hydrolyzing acid is removed and then the sample is reconstituted in a suitable buffer for analysis by an appropriate liquid chromatographic system in which the amino acids are separated and quantified.

The complete hydrolysis of the protein (or peptide) to free amino acids is accomplished by heating the sample at about 110° C., for a suitable period of time, for example, from 8 to 24 hours, in the presence of the concentrated hydrolyzing acid. Oxygen must be removed from the sample, prior to heating it in order to prevent the oxidative decomposition of various amino acids, especially methionine and tryptophan. Typically, the sample is dissolved in about 1 milliliter of the concentrated acid and then is placed in a commercially available ampoule suitable for flame sealing. A high vacuum is applied to the ampoule and the ampoule is vigorously shaken in order to aid in the degassing of the sample. The ampoule is then placed in a high temperature flame where the vacuum serves to collapse the molten glass and provide the seal. These operations are typically performed manually and often result in the operator burning his fingers during the sealing of the ampoules and they cause the formation, on the ampoule, of a thin-walled portion which is much more subject to breakage than the other, normal thickness portions thereof. Also, the ampoule sealing conditions are not strictly reproducible so that the results are not as precise as is desired.

2. Description of the Prior Art

U.S. Pat. No. 1,864,023 to Ledig discloses a machine for sealing hollow glass blanks for ampoules in which a vacuum is applied to an ampoule after the ampoule has been filled with the required quantity of contents. The ampoule is then sealed by the use of burners which revolve around the neck of the ampoule. U.S. Pat. No. 3,188,778 to Winer et al discloses an apparatus for dosing the arc tubes of high pressure mercury discharge lamps. The arc tubes are evacuated and filled with an ionizable starting gas by an automatic exhaust machine, mercury is inserted into the arc tube, a striker arm taps the tubulation part of the arc tube in order to ensure that all of the mercury has fallen into the tube and an annular burner seals off the arc tube. U.S. Pat. No. 2,896,381 to Lange discloses the use of an inert decontaminated gas to flush an ampoule and a sealing flame to close the neck of the ampoule. U.S. Pat. No. 4,596,109 to Miller discloses the deposition of an antibody or an antigen-coated ball in a tube and applying a vacuum on the tube by a vacuum hose while applying heat to the top of the tube by a pair of soldering irons in order to seal the tube. U.S. Pat. Nos. 2,198,752 and 2,353,985 to Barr disclose apparatuses for preserving biologically active substances in which the substance is sealed in a vial by pulling a vacuum on the vial, inserting a rubber stopper into the neck of the vial and using a flame to seal the neck of the vial above the stopper. However, none of the prior art references teach or suggest the apparatus of the present invention.

SUMMARY OF THE INVENTION

It is an object of the present invention to provide an apparatus for removing gas from the interior of an ampoule and then flame-sealing the ampoule in which the application of the vacuum and the flame-sealing of the ampoule are effected by an integrated operation so that the operation is less labor intensive, safer and gives more precise, reproducible results.

It is a further object of the present invention to provide an ampoule sealing apparatus, as aforesaid, which includes means for vibrating the ampoule, introducing an inert gas into the ampoule and pulling a vacuum on the interior of the ampoule in order to help evacuate air therefrom.

It is a still further object of the present invention to provide an ampoule sealing apparatus, as aforesaid, which comprises a horseshoe-shaped gas burner effective for uniformly sealing the neck of an ampoule and means for shutting off the fuel flow to the gas burner if it is determined that the burner has not lit after a predetermined period of time or the flame has been extinguished during a cycle of operation of the apparatus.

These and other objects are accomplished by the ampoule sealing apparatus according to the present invention which comprises a base, a pivotable arm and a horseshoe-shaped burner attached to the base. The pivotable arm moves an unsealed ampoule from a first position remote from the burner to a second position in which the ampoule is disposed inside the perimeter of the burner. Means for evacuating air from the ampoule is provided on the upper end of the pivotable arm. The horseshoe-shaped burner is shaped so that the neck of the ampoule is received within the perimeter thereof. A thermocouple control means is associated with the burner so that the fuel flow to the burner can be shut off, if it is determined that the burner has not lit or has gone out, after a predetermined period of time.

DETAILED DESCRIPTION OF THE INVENTION

Figure 1:
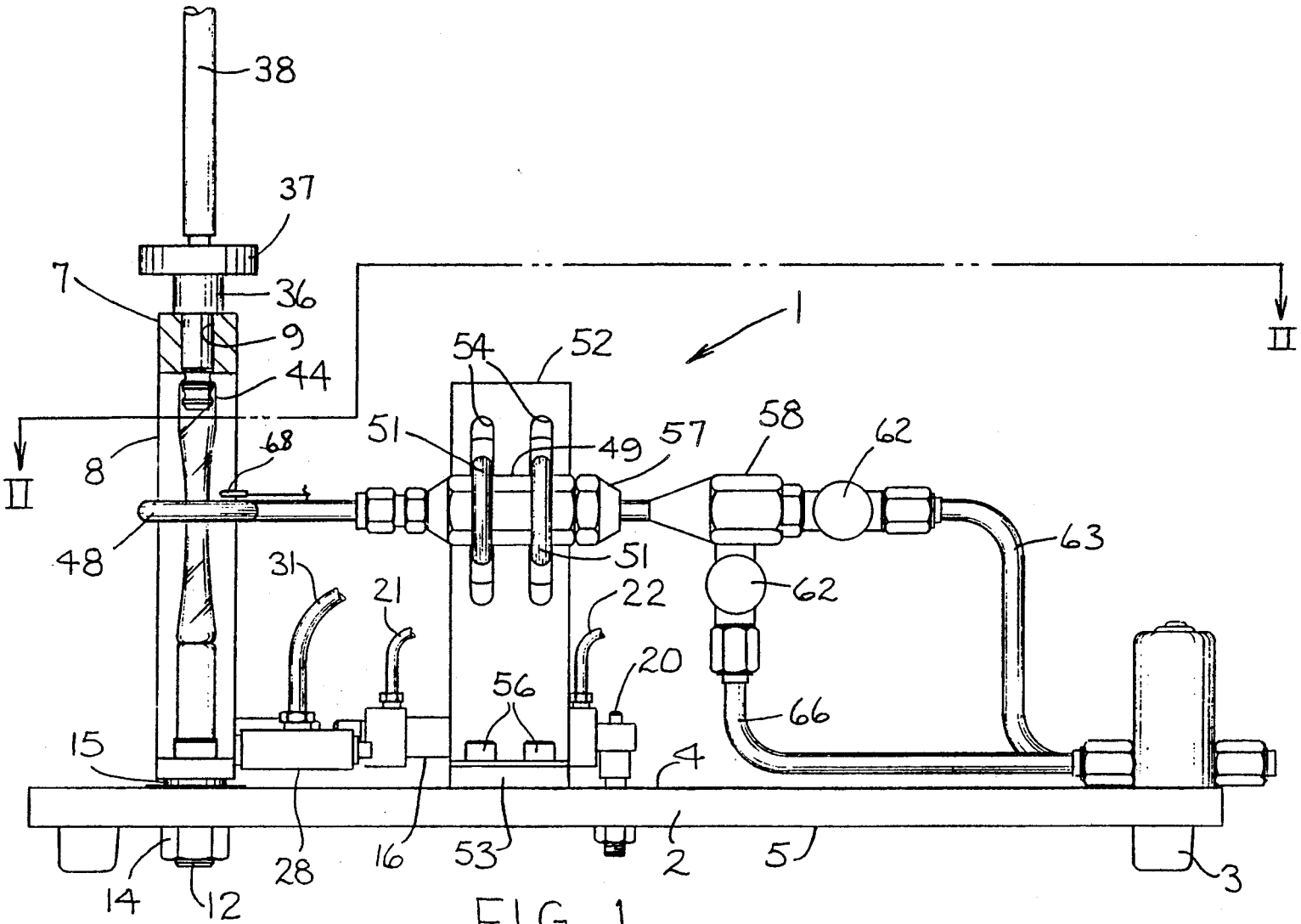
FIG. 1 is a side elevational view of an embodiment of the ampoule sealing apparatus of the present invention.

Referring in detail now to the drawings wherein like reference numerals designate similar parts throughout the various views, the ampoule sealing apparatus 1 comprises a base 2 having a planar upper surface 4 and a planar lower surface 5 which are parallel to each other. Support legs 3 are attached to the lower surface 5 and are adapted to support the base 2 on any suitable support. A mechanical arm assembly 6, comprising an upper horizontal member 7, a vertical intermediate member 8 and a lower horizontal member 11, is mounted on the base 2 for pivotal movement about a vertical axis which is parallel with and laterally offset from the vertical intermediate member 8. A bolt 12 passes through an opening provided in the lower horizontal member 11, thence through a bearing unit 15 and the base 2. The lower end of bolt 12 is threadedly engaged with a nut 14 at the lower surface 5 of the base 2. The mechanical arm assembly 6 is thereby secured to base plate 2 for pivotal movement with respect to base plate 2 about the vertical axis of bolt 12.

The upper horizontal member 7 of the arm assembly is of a bar-shaped configuration and has a through opening 9 close to the outer end thereof. The inner end of the upper horizontal member 7 is attached to the upper end of the vertical intermediate member 8, for example, by screws 10. A fixture 34 extends through the opening 9. The fixture 34 has a head 35 engaging the upper surface of arm 7 over the opening 9, an intermediate portion 36 extending through the opening 9 and a lower nipple 41 extending downwardly and located below the opening 9. The outer circumference of the head 35 is larger than the diameter of the opening 9 and supports the vacuum tube fixture 34 on the upper surface of the upper horizontal member 7. The outer diameter of the intermediate portion 36 is sized so that said intermediate portion is slidably received within the opening 9. O-rings 42 are provided on the nipple 41 and are sized so as to sealingly engage the upper interior surface of the head 44 of an ampoule 43. A knob 37 is fixedly attached to the head 35 and is connected to a tube 38 which in turn is connected to a three port valve as further described hereinbelow.

The vertical intermediate member 8 of the arm assembly is also of bar-like configuration and is fixedly connected to the lower horizontal member 11 at an upper surface thereof directly below the connection between the mechanical arm upper horizontal member 7 and the mechanical arm vertical intermediate member 8.

Figure 3:
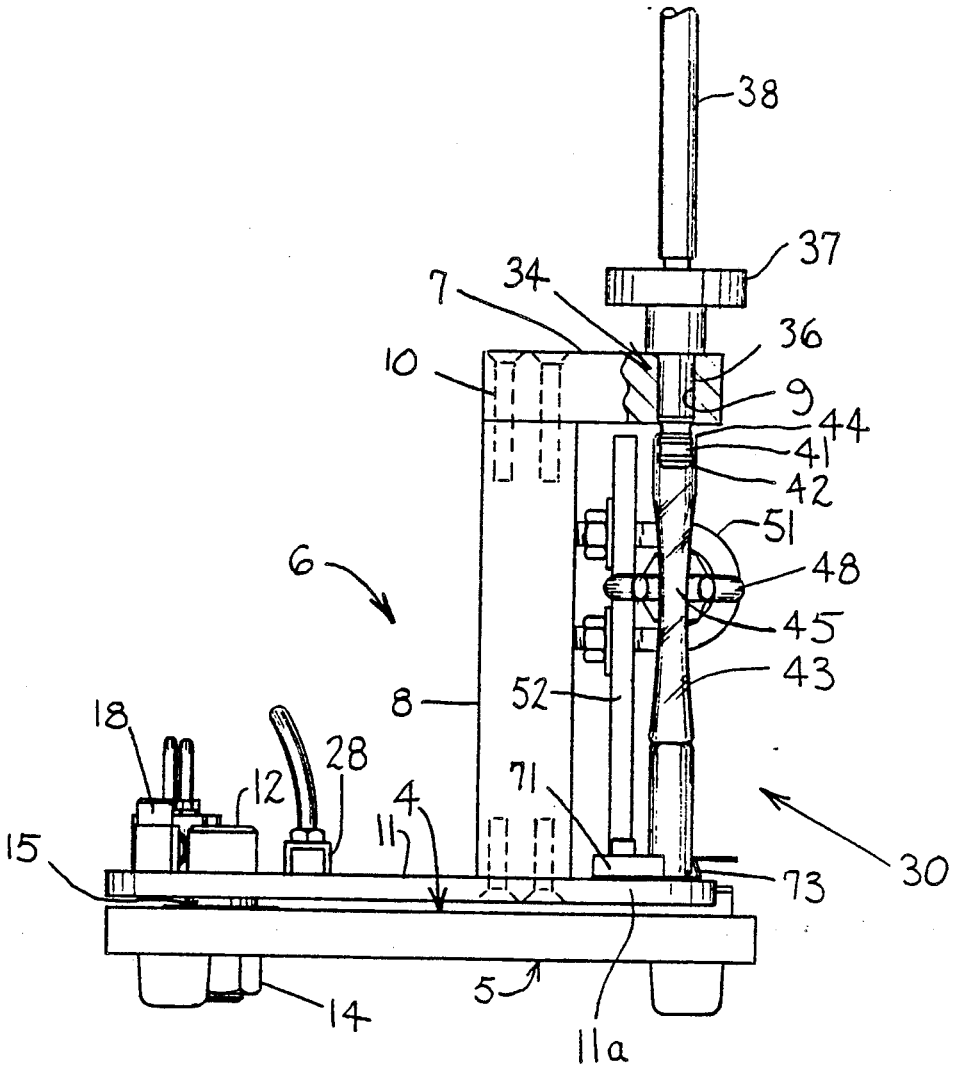
FIG. 3 is a partially broken away, front elevational view of the ampoule sealing apparatus of the present invention.

The mechanical arm lower horizontal member 11 is also of bar-like configuration and is provided with means to support the ampoule 43 thereon. Referring to FIG. 3, the lower horizontal member 11 has a forward section 11*a* which projects forwardly (rightwardly) from arm 8 and is disposed parallel to and vertically aligned with the upper horizontal member 7. The members 7 and 8 and section 11*a* define a cavity 30 for receiving the ampoule 43 and said cavity is open at its forward side (rightward side in FIG. 3). Referring to FIG. 1, a block 71 having a V-shaped wall 72 is mounted on the lower horizontal member 11 so that when the lower end of the ampoule engages said wall 72, the vertical axis of the ampoule will be substantially coaxial with the vertical axis of the vacuum tube fixture 34. A spring clip 73 is associated with the block 71 to releasably retain the lower end of the ampoule and resiliently urge it against wall 72.

A reciprocable piston rod 17 of a pneumatic cylinder 16 is pivotably linked to the rearward end (leftward member 11 by means of a lever 18*a* and a cap screw 18. The opposite end of the pneumatic cylinder 16 (opposite the rod 17) is connected to base 2 by a vertical pivot pin 20 so that the cylinder 16 can pivot with respect to the base 2.

Figure 2:
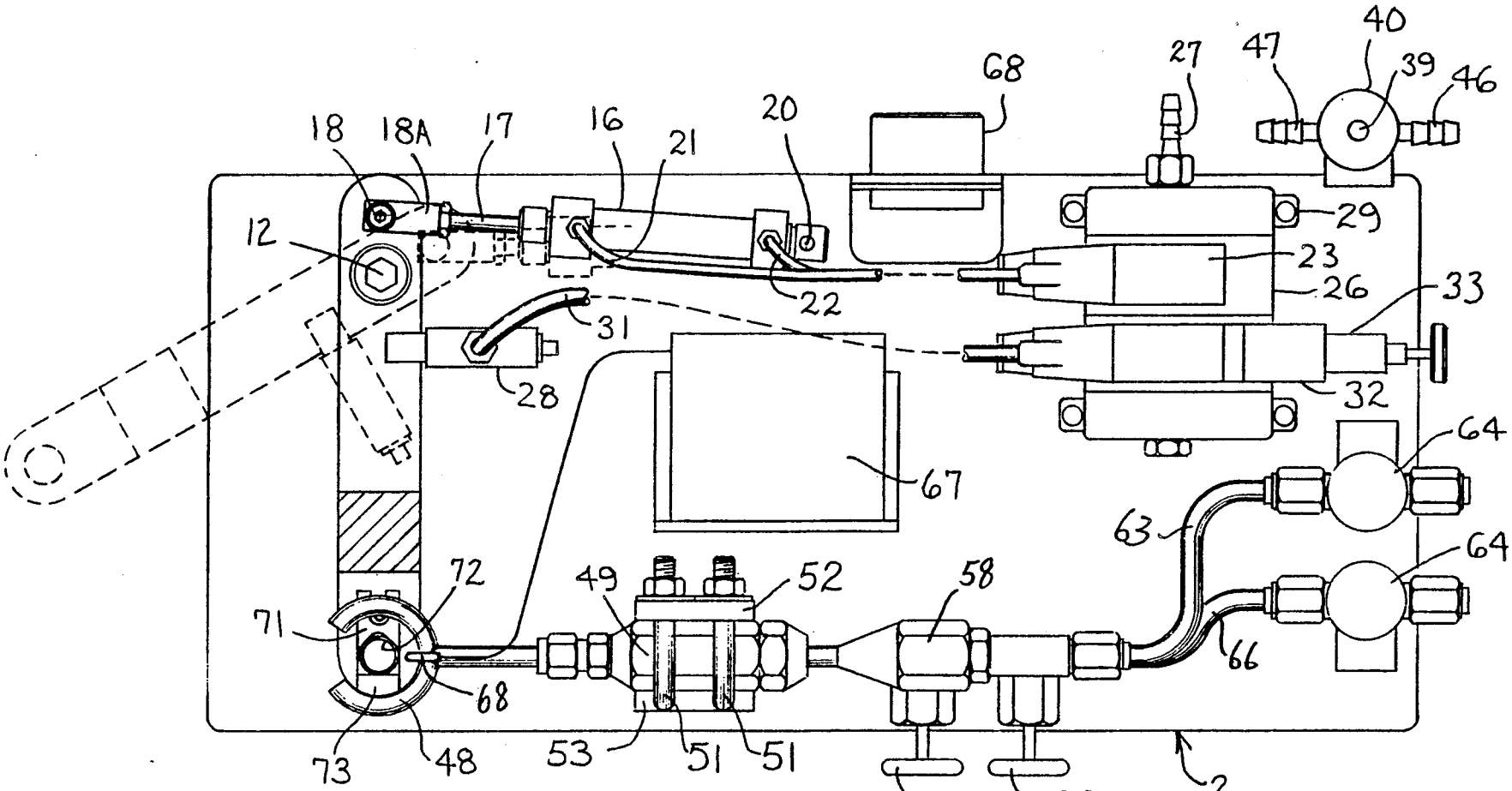
FIG. 2 is a top plan view, taken along the line II—II of FIG. 1, of the ampoule sealing apparatus of the present invention and schematically showing the first or remote position of the arm assembly in broken lines.

Pneumatic lines 21 and 22 extend from opposite ends of the cylinder 16 and they are connected to the cylinder solenoid 23 so that air for pressurizing and depressurizing the pneumatic cylinder 16 can be supplied by operation of the solenoid 23. Upon pressurization of the air cylinder 16, the rod 17 is extended from the broken line position thereof to the solid line position thereof as shown in FIG. 2 and thereby pivots arm assembly 6 from the first, retracted, broken line position thereof to the second, advanced, solid line position, about the pivot axis defined by the screw 12. Upon relief of the air pressure on the cylinder 16, the rod 17 is retracted to its retracted broken line position and thereby reversely pivots the arm assembly 6 about the pivot axis defined by the screw 12 from the second, advanced position back to the first, retracted position thereof.

A pneumatic vibrator 28 is affixed to the lower horizontal member 11 of the arm assembly 6 and is adapted for vibrating the arm assembly 6. A pneumatic line 31 connects the pneumatic vibrator 28 to a vibrator solenoid 32 and serves as the means for introducing pressurized air into the pneumatic vibrator 28. The degree of vibration of the pneumatic vibrator 28 depends on the air pressure supplied to it and the air pressure can be varied by adjusting a pressure regulator 33 provided in association with the vibrator solenoid 32. The cylinder solenoid 23 and the vibrator solenoid 32 are in fluid communication with and are attached to a pneumatic valve 26 which is secured to the upper surface of the base 2 by bolts 29. A compressed air inlet nipple 27 is provided on the side of the pneumatic valve 26 and connects the pneumatic valve 26 to a source of compressed air (not shown).

Referring to FIG. 2, in a preferred embodiment of the invention, the tube 38 of the fixture 34 is connected to a three port solenoid valve 40 for alternatively supplying an inert purge gas, such as nitrogen gas, or drawing a vacuum on the interior of the ampoule 43. The valve 40 has three nipples. The first nipple 46 is connected to the tube 38 and supplies the purge gas to and pulls a vacuum on the interior of the ampoule 43. A second nipple 47 is connected to a vacuum source (not shown) while the third nipple 39 is connected to a source of an inert purge gas (not shown). During one mode of operation of the solenoid valve 40, an inert gas is introduced into the interior of the ampoule 43 in order to purge air therefrom. Then the valve 40 is operated so that a vacuum is pulled on the interior of the ampoule in order to further evacuate air from the ampoule. A programmable number of cycles, for example, three cycles, of alternate purge gas supply and air evacuation steps can be provided for each ampoule sealing operation.

When the use of an inert purge gas can be dispensed with, the valve 40 can be omitted and the tube 38 can be connected to a vacuum source.

A vertical support member 52 having a flanged bottom 53 is attached to the upper surface of the base plate 2 toward the forward side thereof (rightward side in FIG. 3). A substantially horseshoe-shaped burner 48 is connected to a body 49. The body 49 is adjustably supported on the vertical support member 52 by means of U-bolts 51 which extend through slots 54 provided in the vertical support member 52. The horseshoe-shaped burner 48 defines an interior cavity therein which cavity is open along the leftward side thereof in FIG. 2. The cavity is situated so that the neck 45 of the ampoule 43 is received therein when the arm assembly 6 is in the second or advanced position. A flame check valve 57 is attached to the burner body 49 and prevents the flame from entering the fuel supply lines. A venturi gas mixer 58 receives oxygen from a oxygen supply line 63 and a natural gas supply line 66 and mixes the gases therein whereby to supply the fuel gas to the gas burner 48. Needle valves 62 are provided in the oxygen supply line 63 and the natural gas supply line 66 to regulate the flow therethrough. Additional valves 64 are placed in the oxygen supply line 63 and the natural gas supply line 66 in order to allow or shut off flow therethrough.

A thermocouple controller 67 is mounted on the central portion of the base 2 and is connected to a thermocouple 68 which monitors the temperature of the burner 48 and the flow of oxygen and natural gas through lines 63 and 66. If the burner 48 is not lit within a predetermined period of time or if the flame goes out, thermocouple controller 67 shuts off the flow of oxygen and natural gas to the burner 48. The thermocouple controller 67 must then be reset in order to again supply air and natural gas to the burner 48. A controller plug-in 68 is also provided on the base 2 and serves as means by which a programmable controller (not shown) can input signals to control the operation of various pieces of equipment of the system.

DESCRIPTION OF OPERATION

The operation of the ampoule sealing apparatus of the present invention is as follows. The arm assembly 6 is in its first or retracted position because the pneumatic cylinder 16 has not yet been pressurized. The valves 64 in the oxygen supply line 63 and the natural gas supply line 66 are open. Needle valves 62 in the oxygen supply line 63 and the natural gas supply line 66 are then adjusted to achieve a suitable fuel mixture and the burner 48 is lit. If the burner 48 is not lit within a predetermined period of time, the thermocouple controller 67 will cause the flow of fuel and oxygen to the burner 48 to be shut off. This will also happen it the flame goes out during operation. A sample comprising a protein or polypeptide and a suitable amount of concentrated acid effective for hydrolyzing the sample is placed in an open ampoule 43. The base of the ampoule 43 is placed against the V-shaped wall 72 and is held thereagainst by the spring clip 73 and the ampoule head 44 is then placed over the nipple 41 and O-rings 42. The vibrator solenoid 33 is actuated to pressurize the vibrator 28 by means of pressurized air supplied by the pneumatic line 31. This causes the vibrator 28 to impart vibration to the arm assembly 6 to agitate the contents of the ampoule and help dislodge air that may be contained in the sample. Simultaneously, when valve 40 is used, that valve is actuated to send a flow of inert gas into the interior of the ampoule 43 via the line 38. Then, while continuing to vibrate the arm assembly 6, the valve 40 is actuated to pull a vacuum on the interior of the ampoule 43 whereby to evacuate gas contained therein. The cycle of steps of (1) supplying inert purge gas to the ampoule, and then (2) evacuating gas from the ampoule, is repeated a programmable number of times, for example three times, while the ampoule is in its first or retracted position, and while the arm assembly is vibrated. Then, the vibrator 28 is turned off, the vacuum is turned on and the pneumatic air cylinder solenoid 23 is actuated to supply pressurized air to the cylinder 16 and thereby cause the arm 17 to be extended. The extension of the arm 17 causes the arm assembly 6 to pivot about its vertical pivot axis and move into a second or advanced position which places the ampoule neck into the cavity defined by the horseshoe-shaped burner 48. The heating of the ampoule neck 45 by the gas burner 48 and the pulling of a vacuum on the ampoule 45 causes the ampoule neck 45 to collapse and form a seal. After the seal is formed, the vacuum is turned off and the solenoid valve 23 is actuated to reverse the pressure on the pneumatic cylinder 16 which causes the arm 17 to retract and thereby pivots the arm assembly 6 back to the first position. The sealed ampoule can then be removed and a new ampoule placed therein for repeating the cycle of operation.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. An ampoule sealing apparatus comprising:
means for receiving an unsealed ampoule;
means for pivotably moving said unsealed ampoule sequentially from a first position to a second position and back to said first position;
means for vibrating said unsealed ampoule at said first position;
means for pulling a vacuum on said unsealed ampoule at both of said positions and removing air therefrom; and
means for heating and sealing said ampoule at said second position.

2. The ampoule sealing apparatus of claim 1, additionally comprising means for introducing an inert gas into said unsealed ampoule at said first position in order to purge air therefrom.

3. The ampoule sealing apparatus of claim 1 wherein said means for pivotably moving said unsealed ampoule comprises a pivotable arm.

4. The ampoule sealing apparatus of claim 1, wherein said means for vibrating said unsealed ampoule is attached to said means for pivotably moving said unsealed ampoule.

5. The ampoule sealing apparatus of claim 1, including a thermocouple for detecting if said means for heating is operative.

6. An ampoule sealing apparatus comprising:
means for receiving an unsealed ampoule;
means for pivotably moving said unsealed ampoule from a first position to a second position;
means for vibrating said unsealed ampoule at said first position;
means for pulling a vacuum on said unsealed ampoule at both of said positions and removing air therefrom; and
a horseshoe-shaped burner for heating and sealing said ampoule at said second position.

7. An ampoule sealing apparatus comprising:
a mechanical arm, said mechanical arm having means for receiving an unsealed ampoule at a first end thereof and means provided at an opposite end thereof for pivoting said unsealed ampoule from a first position to a second position;
a vibrator, said vibrator being attached to said mechanical arm so as to induce agitation in said unsealed ampoule;
a horseshoe-shaped burner, said horseshoe-shaped burner being located at said second position and positioned so as to receive said unsealed ampoule in an inner area defined thereby;

a thermocouple, said thermocouple being associated with said horseshoe-shaped burner so as to determine whether said burner is lit;

control means, said control means being associated with said thermocouple so as to shut off fuel to said burner if said burner is not lit within a specified period of time; and air removal means, said air removal means being connected to said mechanical arm at said first end thereof and comprising means for introducing an inert gas into the interior of said unsealed ampoule and means for pulling a vacuum on said unsealed ampoule.

* * * * *

UNITED STATES PATENT AND TRADEMARK OFFICE

CERTIFICATE OF CORRECTION

PATENT NO. : 4 995 222

DATED : February 26, 1991

INVENTOR(S) : Charles R. WHITMAN et al

It is certified that error appears in the above-identified patent and that said Letters Patent is hereby corrected as shown below:

Column 3, line 63; after "leftward" insert ---end in Fig. 3) of the mechanical arm lower horizontal---.

Column 5, line 38; change "it" to ---if---.

Column 6, line 35; after "1" insert a comma.

Signed and Sealed this

Eighteenth Day of August, 1992

*Attest:*

DOUGLAS B. COMER

*Attesting Officer*

*Acting Commissioner of Patents and Trademarks*